US011168863B2

(12) United States Patent
Hino

(10) Patent No.: US 11,168,863 B2
(45) Date of Patent: Nov. 9, 2021

(54) VEHICULAR LUMINAIRE, VEHICULAR LAMP, AND METHOD FOR MANUFACTURING VEHICULAR LUMINAIRE

(71) Applicant: Toshiba Lighting & Technology Corporation, Yokosuka (JP)

(72) Inventor: Kiyokazu Hino, Yokosuka (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 341 days.

(21) Appl. No.: 16/243,329

(22) Filed: Jan. 9, 2019

(65) Prior Publication Data

US 2019/0277472 A1 Sep. 12, 2019

(30) Foreign Application Priority Data

Mar. 6, 2018 (JP) ..... JP2018-039213

(51) Int. Cl.

| | |
|---|---|
| ***F21S 43/00*** | (2018.01) |
| ***F21S 43/19*** | (2018.01) |
| ***F21S 45/48*** | (2018.01) |
| ***F21V 15/01*** | (2006.01) |
| ***F21V 17/14*** | (2006.01) |
| ***F21V 23/00*** | (2015.01) |
| ***F21S 43/14*** | (2018.01) |
| ***F21S 45/49*** | (2018.01) |
| *F21W 103/10* | (2018.01) |
| *F21W 103/20* | (2018.01) |
| *F21W 103/55* | (2018.01) |

(52) U.S. Cl.

CPC ..... *F21S 43/195* (2018.01); *F21S 43/14* (2018.01); *F21S 45/48* (2018.01); *F21S 45/49* (2018.01); *F21V 15/01* (2013.01); *F21V 17/14* (2013.01); *F21V 23/005* (2013.01); *F21W 2103/10* (2018.01); *F21W 2103/20* (2018.01); *F21W 2103/55* (2018.01)

(58) Field of Classification Search

CPC ..... F21S 43/19; F21S 43/195; F21S 45/48; F21S 45/49; F21V 15/01; F21V 17/14; F21V 23/005

See application file for complete search history.

(56) References Cited

U.S. PATENT DOCUMENTS

2005/0067931 A1* 3/2005 Coushaine ..... F21V 29/70 313/46
2009/0045933 A1* 2/2009 Smith ..... H05B 45/00 340/468

(Continued)

FOREIGN PATENT DOCUMENTS

EP 2345836 A2 7/2011
EP 3277056 A1 1/2018

(Continued)

*Primary Examiner* — Gerald J Sufleta, II
(74) *Attorney, Agent, or Firm* — Banner & Witcoff, Ltd.

(57) ABSTRACT

A vehicular luminaire according to embodiments includes a socket; a substrate provided on the socket and including a wiring pattern on at least one surface; at least one light-emitting element electrically connected to the wiring pattern; and a plurality of power-supply terminals extending inside the socket and including one end portion exposed from the socket, the vicinity of the end portion being bent toward the substrate.

20 Claims, 7 Drawing Sheets

(56) References Cited

U.S. PATENT DOCUMENTS

| | | | | |
|---|---|---|---|---|
| 2011/0175529 | A1* | 7/2011 | Hayashi | F21K 9/20 315/77 |
| 2013/0242592 | A1* | 9/2013 | Foo | F21V 29/85 362/547 |
| 2013/0250602 | A1* | 9/2013 | Tsukamoto | F21S 41/192 362/547 |
| 2014/0268842 | A1* | 9/2014 | Simchak | F21S 41/19 362/487 |
| 2015/0016136 | A1* | 1/2015 | Nakano | F21S 45/48 362/520 |
| 2015/0211725 | A1* | 7/2015 | Ikuta | F21S 41/192 362/382 |
| 2016/0363268 | A1* | 12/2016 | Kim | F21K 9/232 |
| 2017/0363255 | A1* | 12/2017 | Cuche | F21K 9/232 |
| 2018/0073714 | A1* | 3/2018 | Ozawa | F21S 43/40 |
| 2018/0187858 | A1* | 7/2018 | Serrano | F21V 23/06 |
| 2018/0245766 | A1* | 8/2018 | Mussetter | B60Q 1/2607 |

FOREIGN PATENT DOCUMENTS

| | | | |
|---|---|---|---|
| JP | 2011-119168 | A | 6/2011 |
| JP | 2011-171276 | A | 9/2011 |
| JP | 2013-247061 | A | 12/2013 |
| JP | 2014-238981 | A | 12/2014 |
| JP | 2015-060753 | A | 3/2015 |
| JP | 2017-004773 | A | 1/2017 |
| WO | 2015-012084 | A1 | 1/2015 |
| WO | 2016/158423 | A1 | 10/2016 |

* cited by examiner

VEHICULAR LUMINAIRE, VEHICULAR LAMP, AND METHOD FOR MANUFACTURING VEHICULAR LUMINAIRE

CROSS-REFERENCE TO RELATED APPLICATIONS

This application is based upon and claims the benefit of priority from Japanese Patent Application No. 2018-039213, filed on Mar. 6, 2018; the entire contents of which are incorporated herein by reference.

FIELD

Embodiments described herein relate generally to a vehicular luminaire, a vehicular lamp, and a method for manufacturing a vehicular luminaire.

BACKGROUND

A vehicular luminaire is provided with a socket, a light-emitting module provided on one end portion side of the socket, and a plurality of power-supply terminals provided inside the socket and electrically connected to the light-emitting module. The light-emitting module has a substrate provided with a wiring pattern and a light-emitting diode (LED) electrically connected to the wiring pattern. One end portion of the plurality of power-supply terminals is soldered to the wiring pattern provided on the substrate.

Compact vehicular luminaires are in demand nowadays. The planar dimension of a substrate provided in a light-emitting module needs to be reduced for a vehicular luminaire to be reduced in size.

A light-emitting element, a resistor, and the like are mounted on the substrate with a plurality of power-supply terminals soldered. In this case, a decrease in light-emitting element size, resistor size, and so on and an increase in mounting density are limited in view of vehicular luminaire functions.

In addition, respective end portions of the plurality of power-supply terminals are soldered in a state of being inserted in holes provided in the substrate. Accordingly, the substrate is provided with the plurality of holes for power-supply terminal insertion and lands respectively surrounding the plurality of holes. When the plurality of lands are provided, the region where the plurality of power-supply terminals and a wiring pattern are electrically connected to each other is large in area.

Accordingly, a decrease in the planar dimension of the substrate is limited.

In this regard, development of a technique with which the planar dimension of a substrate can be reduced is desired.

DETAILED DESCRIPTION

Figure 1:
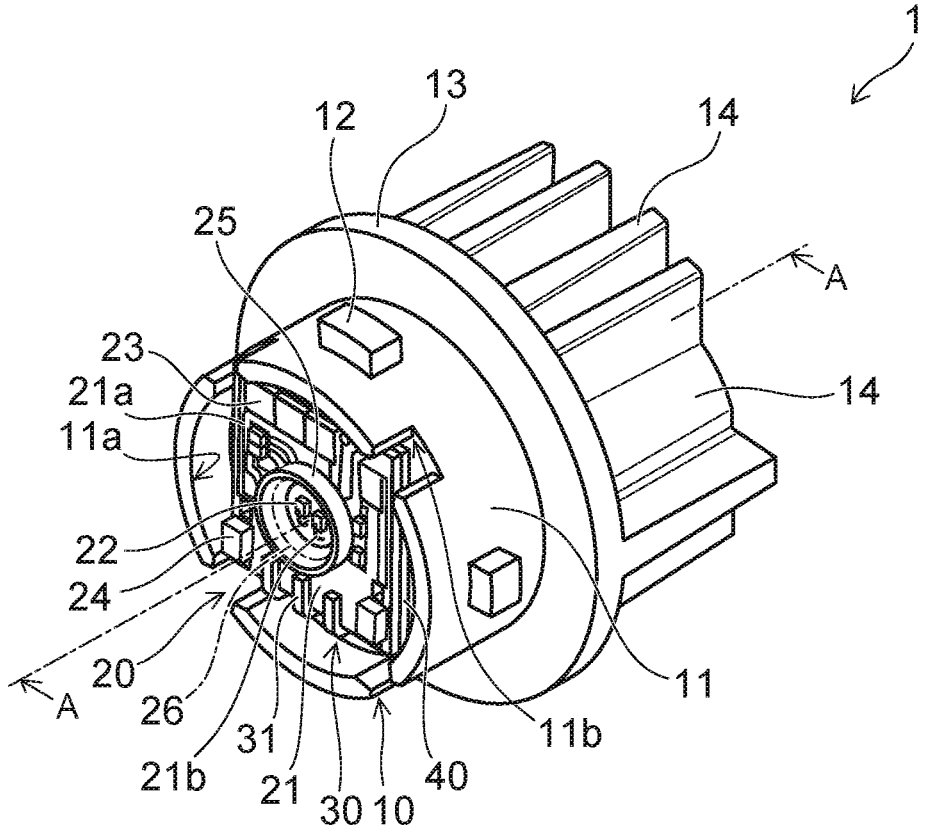
FIG. 1 is a schematic perspective view for exemplifying a vehicular luminaire according to the present embodiment.

A vehicular luminaire according to embodiments includes a socket; a substrate provided on the socket and including a wiring pattern on at least one surface; at least one light-emitting element electrically connected to the wiring pattern; and a plurality of power-supply terminals extending inside the socket and including one end portion exposed from the socket, the vicinity of the end portion being bent toward the substrate.

Hereinafter, embodiments will be exemplified with reference to accompanying drawings. In the drawings, the same components are denoted by the same reference numerals so that detailed description is omitted as appropriate.

(Vehicular Luminaire)

A vehicular luminaire 1 according to the present embodiment can be provided in an automobile, a railroad vehicle, or the like. Examples of the vehicular luminaire 1 that is provided in an automobile include the vehicular luminaire 1 used in a front combination light (appropriately combining a daylight running lamp (DRL), a position lamp, a turn signal lamp, and so on) and the vehicular luminaire 1 used in a rear combination light (appropriately combining a stop lamp, a tail lamp, a turn signal lamp, a back lamp, a fog lamp, and so on). However, the applications of the vehicular luminaire 1 are not limited to the above description.

FIG. 1 is a schematic perspective view for exemplifying the vehicular luminaire 1 according to the present embodiment.

Figure 2:
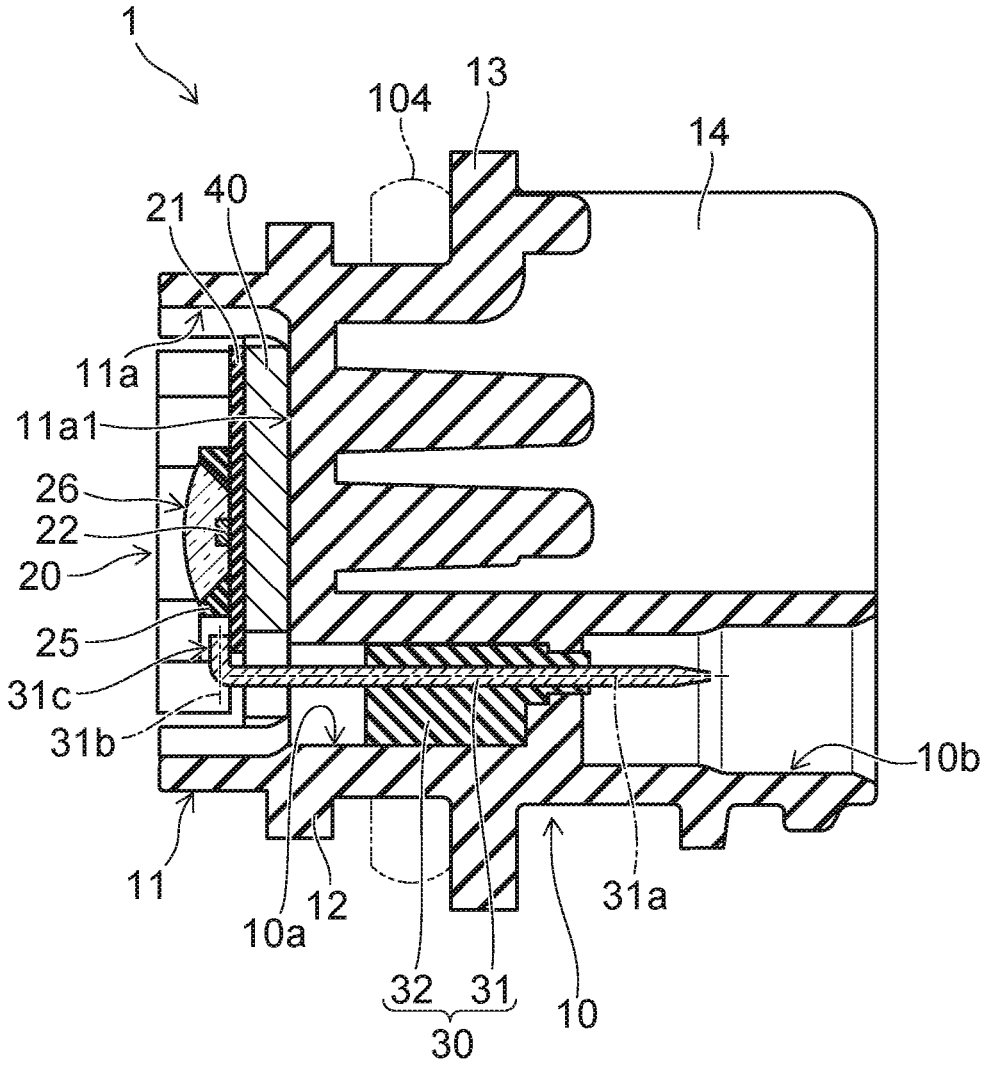
FIG. 2 is a cross-sectional view taken along line A-A of a vehicular luminaire 1 in FIG. 1.

FIG. 2 is a cross-sectional view taken along line A-A of the vehicular luminaire 1 in FIG. 1.

Figure 3:
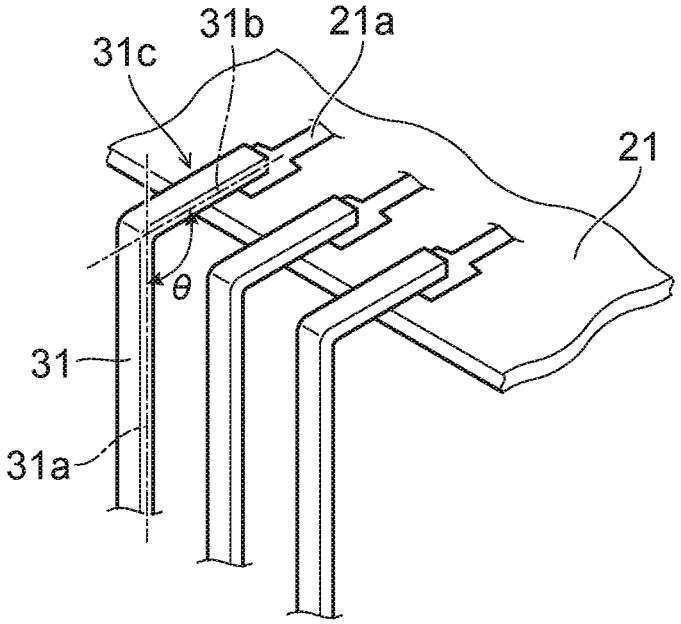
FIG. 3 is a schematic perspective view for exemplifying the form of the end portions of a plurality of power-supply terminals that are on a light-emitting module side.

FIG. 3 is a schematic perspective view for exemplifying the form of the end portions of a plurality of power-supply terminals 31 that are on a light-emitting module 20 side.

As illustrated in FIGS. 1 and 2, the vehicular luminaire 1 is provided with a socket 10, the light-emitting module 20, a power-supply unit 30, and a heat transfer unit 40.

The socket 10 has a mounting portion 11, a bayonet 12, a flange 13, and a thermal radiation fin 14.

The mounting portion 11 is provided on the surface of the flange 13 that is on the side which is opposite to the side on which the thermal radiation fin 14 is provided. The outer shape of the mounting portion 11 may be columnar. The outer shape of the mounting portion 11 is, for example, cylindrical. The mounting portion 11 has a recessed portion 11*a*, which is open to an end face that is on the side which is opposite to the flange 13 side. The light-emitting module 20 is provided on a bottom surface 11*a*1 of the recessed portion 11*a*.

At least one slit 11*b* may be provided in the mounting portion 11. A substrate 21 has a corner portion provided inside the slit 11*b*. The dimension (width dimension) of the slit 11*b* in the circumferential direction of the mounting portion 11 is slightly larger than the dimension of the corner portion of the substrate 21. Accordingly, the substrate 21 can be positioned by inserting the corner portion of the substrate 21 into the slit 11*b*.

The external dimension of the mounting portion 11 can be reduced by the slit 11*b* being provided. Accordingly, the mounting portion 11 can be reduced in size, and the vehicular luminaire 1 can be reduced in size as a result.

The bayonet 12 is provided on the outside surface of the mounting portion 11. The bayonet 12 projects toward the outside of the vehicular luminaire 1. The bayonet 12 faces the flange 13. A plurality of the bayonets 12 are provided. The bayonet 12 is used when the vehicular luminaire 1 is mounted on a housing 101 of a vehicular lamp 100. The bayonet 12 is used for twist lock.

The flange 13 has a plate shape. The flange 13 is capable of having a disk shape or the like. The outside surface of the flange 13 is positioned outside the outside surface of the bayonet 12 in the vehicular luminaire 1.

The thermal radiation fin 14 is provided on the side that is opposite to the mounting portion 11 side of the flange 13. At least one thermal radiation fin 14 may be provided. The socket 10 that is exemplified in FIGS. 1 and 2 is provided with a plurality of the thermal radiation fins. The plurality of thermal radiation fins 14 may be provided side by side in a predetermined direction. The thermal radiation fin 14 is capable of having a plate shape.

The socket 10 is provided with a hole 10*b* into which a connector 105 is inserted.

The connector 105 having a seal member 105*a* is inserted into the hole 10*b*. Accordingly, the cross-sectional shape of the hole 10*b* is adapted to the cross-sectional shape of the connector 105 having the seal member 105*a*.

The heat that is generated in the light-emitting module 20 is mainly transferred to the thermal radiation fin 14 via the mounting portion 11 and the flange 13. The heat transferred to the thermal radiation fin 14 is mainly released from the thermal radiation fin 14 to the outside.

Accordingly, it is preferable that the socket 10 is formed of a highly heat-conductive material. For example, the socket 10 may be formed of a metal such as an aluminum alloy.

Nowadays, it is desired that the socket 10 is light in weight and capable of thermally radiating the heat generated in the light-emitting module 20 with efficiency.

Accordingly, it is preferable that the mounting portion 11, the bayonet 12, the flange 13, and the thermal radiation fin 14 are formed of a highly heat-conductive resin. The highly heat-conductive resin contains, for example, a filler made of an inorganic material and a resin. The highly heat-conductive resin is, for example, a resin such as polyethylene terephthalate (PET) and nylon mixed with a filler made of carbon, aluminum oxide, or the like.

The mounting portion 11, the bayonet 12, the flange 13, and the thermal radiation fin 14 may be molded integrally with the power-supply unit 30 by an insert molding method or the like.

With the socket 10 that contains the highly heat-conductive resin with the mounting portion 11, the bayonet 12, the flange 13, and the thermal radiation fin 14 integrally molded, the heat that is generated in the light-emitting module 20 can be thermally radiated with efficiency. In addition, the weight of the socket 10 can be reduced.

The light-emitting module 20 has the substrate 21, a light-emitting element 22, a resistor 23, a control element 24, a frame portion 25, and a sealing portion 26.

The substrate 21 is provided on one end portion side of the socket 10. The substrate 21 is provided in the heat transfer unit 40 via a bonding portion. In other words, the substrate 21 is bonded to the heat transfer unit 40.

The substrate 21 has a plate shape. The planar shape of the substrate 21 may be, for example, quadrangular. The material and the structure of the substrate 21 are not particularly limited. For example, the substrate 21 may be formed of an inorganic material such as ceramics (aluminum oxide, aluminum nitride, or the like), an organic material such as paper phenol and glass epoxy, or the like. In addition, the substrate 21 may be obtained by the surface of a metal plate being coated with an insulating material. When the surface of the metal plate is coated with the insulating material, the insulating material may be made of an organic material or an inorganic material. When the light-emitting element 22 generates a large amount of heat, it is preferable from the viewpoint of thermal radiation to form the substrate 21 by using a highly heat-conductive material. Examples of the highly heat-conductive material include ceramics such as aluminum oxide and aluminum nitride, a highly heat-conductive resin, and a material obtained by the surface of a metal plate being coated with an insulating material. The substrate 21 may have a single layer or multiple layers.

The substrate 21 has a surface provided with a wiring pattern 21*a*. As will be described later, the wiring pattern 21*a* can also be provided on both surfaces of the substrate 21. In other words, the wiring pattern 21*a* may be provided on at least one surface of the substrate 21. The wiring pattern 21*a* may be formed of, for example, a material containing silver as a main component. The wiring pattern 21*a* may be formed of, for example, silver or a silver alloy. However, the material of the wiring pattern 21*a* is not limited to a material containing silver as a main component. The wiring pattern 21*a* can also be formed of, for example, a material containing copper as a main component.

The light-emitting element 22 is provided on the side of the substrate 21 that is opposite to the bottom surface 11*a*1 side of the recessed portion 11*a*. The light-emitting element 22 is provided on the substrate 21. The light-emitting element 22 is electrically connected to the wiring pattern 21*a*.

The light-emitting element 22 may be, for example, a light-emitting diode, an organic light-emitting diode, a laser diode, or the like.

At least one light-emitting element 22 may be provided. When a plurality of the light-emitting elements 22 are provided, the plurality of light-emitting elements 22 may be connected in series to each other. In addition, the light-emitting element 22 is connected in series to the resistor 23.

The light-emitting element 22 may be a chip-shaped light-emitting element. The chip-shaped light-emitting element 22 is mounted by a chip on board (COB). In this manner, it is possible to provide many light-emitting elements 22 in a narrow region. Accordingly, the light-emitting module 20 can be reduced in size, and the vehicular luminaire 1 can be reduced in size as a result. The light-emitting element 22 is electrically connected to the wiring pattern 21*a* by wiring 21*b*. The light-emitting element 22 and the wiring pattern 21*a* may be electrically connected by, for example, a wire bonding method.

The light-emitting element 22 can also be a surface mounting-type light-emitting element or a shell-type light-emitting element having a lead wire.

The resistor 23 is provided on the side of the substrate 21 that is opposite to the bottom surface 11*a*1 side of the recessed portion 11*a*. The resistor 23 is provided on the substrate 21. The resistor 23 is electrically connected to the wiring pattern 21*a*. The resistor 23 may be, for example, a surface mounting-type resistor, a resistor (metal oxide film resistor) having a lead wire, or a film-shaped resistor formed by a screen printing method or the like. The resistor 23 that is exemplified in FIG. 1 is a film-shaped resistor.

The material of the film-shaped resistor may be, for example, ruthenium oxide ($RuO_2$). The film-shaped resistor may be formed by, for example, a screen printing method and a firing method. When the resistor 23 is a film-shaped resistor, the contact area between the resistor 23 and the substrate 21 can be increased, and thus thermal radiation can be improved. In addition, a plurality of the resistors 23 can be formed at the same time. Accordingly, it is possible to improve productivity and it is possible to suppress resistance value variations in the plurality of resistors 23.

The forward voltage characteristics of the light-emitting element 22 have variations. Accordingly, when the applied voltage between anode and ground terminals is constant, the brightness (luminous flux, brightness, luminous intensity, and illuminance) of the light that is irradiated from the light-emitting element 22 varies. Accordingly, the value of the current that flows through the light-emitting element 22 is kept within a predetermined range by the resistor 23 such that the brightness of the light irradiated from the light-emitting element 22 is within a predetermined range. In this case, the value of the current that flows through the light-emitting element 22 is kept within a predetermined range by the resistance value of the resistor 23 being changed.

When the resistor 23 is a surface mounting-type resistor, a resistor having a lead wire, or the like, the resistor 23 that has an appropriate resistance value is selected in accordance with the forward voltage characteristics of the light-emitting element 22. When the resistor 23 is a film-shaped resistor, the resistance value can be increased by a part of the resistor 23 being removed. For example, a part of the resistor 23 can be easily removed when the resistor 23 is irradiated with laser light. The resistor 23 is not limited to the above exemplification in terms of number, size, disposition, and so on. The resistor 23 may be appropriately changed in terms of number, size, disposition, and so on in accordance with, for example, the number and specifications of the light-emitting elements 22.

The control element 24 is provided on the side of the substrate 21 that is opposite to the bottom surface 11*a*1 side of the recessed portion 11*a*. The control element 24 is provided on the substrate 21. The control element 24 is electrically connected to the wiring pattern 21*a*. The control element 24 is provided so that no reverse voltage is applied to the light-emitting element 22 and pulse noise from a reverse direction is not applied to the light-emitting element 22.

The control element 24 may be, for example, a diode or the like. The control element 24 may be, for example, a surface mounting-type diode or a diode having a lead wire. The control element 24 that is exemplified in FIG. 1 is a surface mounting-type diode.

A pull-down resistor may be provided for detection of disconnection of the light-emitting element 22, prevention of erroneous lighting, and so on. It is also possible to provide a coating portion covering the wiring pattern 21*a*, the film-shaped resistor, and the like. The coating portion may contain a glass material or the like.

The frame portion 25 and the sealing portion 26 may be provided when the light-emitting element 22 is a chip-shaped light-emitting element.

The frame portion 25 is provided on the side of the substrate 21 that is opposite to the bottom surface 11*a*1 side of the recessed portion 11*a*. The frame portion 25 is provided on the substrate 21. The frame portion 25 is bonded to the substrate 21. The frame portion 25 has, for example, a tubular shape with the light-emitting element 22 disposed inside. For example, the frame portion 25 surrounds the plurality of light-emitting elements 22. The frame portion 25 may be formed of a resin. The resin may be, for example, a thermoplastic resin such as polybutylene terephthalate (PBT), polycarbonate (PC), PET, nylon, polypropylene (PP), polyethylene (PE), or polystyrene (PS).

In addition, it is possible to improve reflectance with respect to the light that is emitted from the light-emitting element 22 by mixing a resin with particles of titanium oxide or the like. The particles are not limited to titanium oxide particles, and particles made of a material having a high reflectance with respect to the light that is emitted from the light-emitting element 22 may be mixed. The frame portion 25 may be formed of, for example, a white resin or the like as well.

The inner wall surface of the frame portion 25 is an inclined surface that is inclined in a direction away from the central axis of the frame portion 25 as the distance from the substrate 21 increases. Accordingly, the light emitted from the light-emitting element 22 is partially reflected by the inner wall surface of the frame portion 25 and emitted toward the front surface side of the vehicular luminaire 1. In other words, the frame portion 25 is capable of serving to define the formation range of the sealing portion 26 and functioning as a reflector.

The sealing portion 26 is provided inside the frame portion 25. The sealing portion 26 is provided so as to cover the inside of the frame portion 25. In other words, the sealing portion 26 is provided inside the frame portion 25 and covers the light-emitting element 22, the wiring 21*b*, and so on. The sealing portion 26 may be formed of, for example, a translucent material. The sealing portion 26 may be formed by, for example, the inside of the frame portion 25 being filled with a resin. The resin filling may be performed, for example, by means of a liquid dispensing device such as a dispenser. The resin with which the inside of the frame portion 25 is filled may be, for example, a silicone resin or the like.

The sealing portion 26 is capable of containing a phosphor. The phosphor may be, for example, a YAG-based phosphor (yttrium-aluminum-garnet-based phosphor). The type of the phosphor may be appropriately changed such that a desired luminescent color is obtained in accordance with the applications of the vehicular luminaire 1 and so on.

It is also possible to provide only the sealing portion 26 without providing the frame portion 25. When only the sealing portion 26 is provided, the sealing portion 26 that is dome-shaped is provided on the substrate 21.

The heat transfer unit 40 is provided between the substrate 21 and the bottom surface 11*a*1 of the recessed portion 11*a*. The heat transfer unit 40 is provided on the bottom surface 11*a*1 of the recessed portion 11*a* via a bonding portion. In other words, the heat transfer unit 40 is bonded to the bottom surface 11*a*1 of the recessed portion 11*a*.

It is preferable that the adhesive for bonding between the heat transfer unit 40 and the substrate 21 and the adhesive for bonding between the heat transfer unit 40 and the bottom surface 11*a*1 of the recessed portion 11*a* are highly heat-conductive adhesives. For example, each of the adhesives may be an adhesive mixed with a filler using an inorganic material. It is preferable that the inorganic material is a highly heat-conductive material (for example, ceramics such as aluminum oxide and aluminum nitride). The heat conductivity of the adhesive may be, for example, 0.5 W/(m·K) or more and 10 W/(m·K) or less.

The heat transfer unit 40 may be embedded in the bottom surface 11*a*1 of the recessed portion 11*a* by an insert molding method as well. In addition, the heat transfer unit 40 may be attached to the bottom surface 11*a*1 of the recessed portion 11*a* via a layer made of heat-conductive grease (thermal radiation grease). The heat-conductive grease is not particularly limited in terms of type and it is possible to use, for example, a mixture of modified silicone and a filler using a highly heat-conductive material (for example, ceramics such as aluminum oxide and aluminum nitride). The heat conductivity of the heat-conductive grease may be, for example, 1 W/(m·K) or more and 5 W/(m·K) or less.

The heat transfer unit 40 is provided so that the heat that is generated in the light-emitting module 20 is easily transferred to the socket 10. Accordingly, it is preferable that the heat transfer unit 40 is formed of a highly heat-conductive material. The heat transfer unit 40 has a plate shape and may be formed of a metal such as aluminum, aluminum alloy, copper, and copper alloy.

Although the heat transfer unit 40 is not always necessary and may be omitted, thermal radiation can be improved when the heat transfer unit 40 is provided.

The power-supply unit 30 has the plurality of power-supply terminals 31 and an insulating portion 32.

As described above, it is preferable that the socket 10 is formed of a highly heat-conductive material. However, a highly heat-conductive material may have electrical conductivity. For example, a metal such as an aluminum alloy, a highly heat-conductive resin containing a filler made of carbon, and the like have electrical conductivity. Accordingly, the insulating portion 32 is provided for insulation between the plurality of power-supply terminals 31 and the electrically conductive socket 10. The insulating portion 32 serves to hold the plurality of power-supply terminals 31 as well. The insulating portion 32 may be omitted when the socket 10 is formed of a highly heat-conductive insulating resin (such as a highly heat-conductive resin containing a filler made of aluminum oxide). In this case, the socket 10 holds the plurality of power-supply terminals 31.

The insulating portion 32 has insulating properties. The insulating portion 32 may be formed of an insulating resin.

The vehicular luminaire 1 that is provided in an automobile has a temperature of use environment of 40° C. below zero to 85° C. above zero. Accordingly, it is preferable that the thermal expansion coefficient of the material of the insulating portion 32 is as close as possible to the thermal expansion coefficient of the material of the socket 10. In this manner, it is possible to reduce the thermal stress that is generated between the insulating portion 32 and the socket 10. For example, the material of the insulating portion 32 may be the resin that constitutes the highly heat-conductive resin contained in the socket 10.

The insulating portion 32 may be, for example, press-fitted into a hole 10*a* provided in the socket 10 or bonded to the inner wall of the hole 10*a*. Also, the socket 10 and the power-supply unit 30 may be integrally molded by an insert molding method.

The plurality of power-supply terminals 31 are electrically conductive. The plurality of power-supply terminals 31 may be formed of a metal such as a copper alloy.

The plurality of power-supply terminals 31 may be provided side by side in a predetermined direction. The plurality of power-supply terminals 31 are provided inside the insulating portion 32. The plurality of power-supply terminals 31 extend inside the insulating portion 32 and project from the end face of the insulating portion 32 that is on the light-emitting module 20 side and the end face of the insulating portion 32 that is on the thermal radiation fin 14 side.

The end portions of the plurality of power-supply terminals 31 that are on the thermal radiation fin 14 side are exposed inside the hole 10*b*. The connector 105 is fitted to the plurality of power-supply terminals 31 exposed inside the hole 10*b*.

The end portions of the plurality of power-supply terminals 31 that are on the light-emitting module 20 side are electrically connected to the wiring pattern 21*a* provided on the substrate 21. The end portions of the plurality of power-supply terminals 31 on the light-emitting module 20 side that are exemplified in FIGS. 1 and 2 are soldered to the wiring pattern 21*a*.

The power-supply terminal 31 is not limited to the above exemplification in terms of number, disposition, material, and so on. The power-supply terminal 31 may be appropriately changed in terms of number, disposition, material, and so on.

The planar dimension of the substrate 21 provided in the light-emitting module 20 needs to be reduced for the vehicular luminaire 1 to be reduced in size.

The substrate 21 is provided with the light-emitting element 22, the resistor 23, the control element 24, the frame portion 25, and the sealing portion 26. In this case, it is possible to reduce the planar dimension of the substrate 21 by reducing the sizes of the elements, reducing the numbers of the elements, or increasing the mounting density of the elements. However, a decrease in total luminous flux may arise or predetermined luminous intensity distribution characteristics may be unobtainable when the sizes of the elements are reduced, the numbers of the elements are reduced, or the mounting density of the elements is increased. In other words, functions required for the vehicular luminaire 1 may be unobtainable.

Accordingly, it is difficult to reduce the planar dimension of the substrate 21 by reducing the area occupied by the elements.

In general, respective end portions of a plurality of power-supply terminals are soldered in a state of being inserted in holes provided in a substrate. Accordingly, the substrate is provided with the plurality of holes for power-supply terminal insertion and lands respectively surrounding the plurality of holes. When the plurality of lands are provided, the region where the plurality of power-supply terminals and a wiring pattern are electrically connected to each other is large in area.

In this case, the functions required for the vehicular luminaire 1, such as the total luminous flux and the luminous intensity distribution characteristics, are unlikely to be impaired even if the region where the plurality of power-supply terminals and the wiring pattern are electrically connected to each other is reduced.

In this regard, the region where the plurality of power-supply terminals 31 and the wiring pattern 21*a* are electrically connected to each other is reduced in the vehicular luminaire 1 according to the present embodiment.

As illustrated in FIGS. 2 and 3, the end portions of the plurality of power-supply terminals 31 that are on the light-emitting module 20 side are bent. In other words, the plurality of power-supply terminals 31 extend inside the socket 10 with one end portion exposed from the socket 10. The vicinity of the end portion is bent toward the substrate 21. The end portion is provided on the surface of the substrate 21 that is on the side where the light-emitting element 22 is provided. As will be described later, the end portion may also be provided on the surface of the substrate 21 that is on the side which is opposite to the side where the light-emitting element 22 is provided. In other words, the substrate 21 is not provided with holes for insertion of the plurality of power-supply terminals 31.

A center line 31*b* of a part 31*c* of the power-supply terminal 31 that is bent toward the substrate 21 intersects with a center line 31*a* of a part extending inside the socket 10 (insulating portion 32).

An angle θ formed by the center line 31*a* and the center line 31*b* is not limited insofar as the power-supply terminal 31 has a tip that can be soldered to the wiring pattern 21*a*. In this case, the tip of the power-supply terminal 31 is likely to come into contact with the wiring pattern 21*a* if the angle θ is 90° or less. Accordingly, it is preferable that the angle θ is 90° or less.

The angle θ is approximately 90° in the power-supply terminal 31 that is exemplified in FIGS. 2 and 3. In this manner, the power-supply terminal 31 can be manufactured with ease.

The tip side of the power-supply terminal 31 extends in a direction that is substantially parallel to the surface of the substrate 21. Accordingly, the contact part between the tip side of the power-supply terminal 31 and the wiring pattern 21*a* can be lengthened. In addition, soldering is facilitated.

With the power-supply terminal 31 according to the present embodiment, the region where the plurality of power-supply terminals 31 and the wiring pattern 21*a* are electrically connected to each other can be smaller than when a power-supply terminal is provided in a hole provided in a substrate. For example, when the hole is provided in the substrate, a region is required between the center of the hole provided in the substrate and the end face of the substrate. With the power-supply terminal 31 according to the present embodiment, the region where the plurality of power-supply terminals 31 and the wiring pattern 21*a* are electrically connected to each other is reduced by an amount corresponding to the region. Accordingly, the size of the substrate 21 is reduced, and the vehicular luminaire 1 can be reduced in size as a result.

Figure 4A:
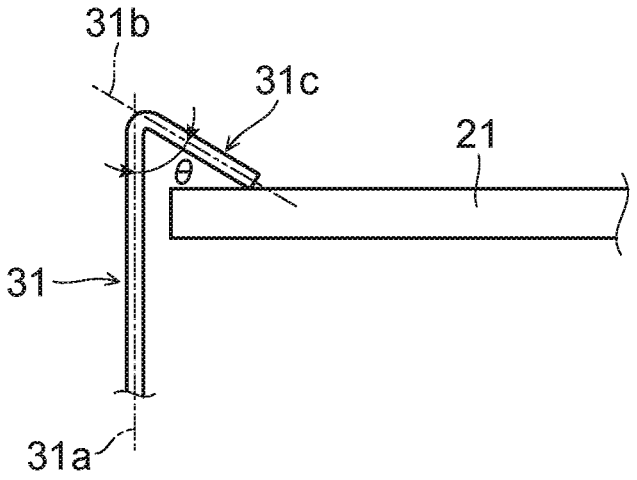
FIGS. 4A and 4B are schematic diagrams for exemplifying the power-supply terminal according to another embodiment.
Figure 4B:
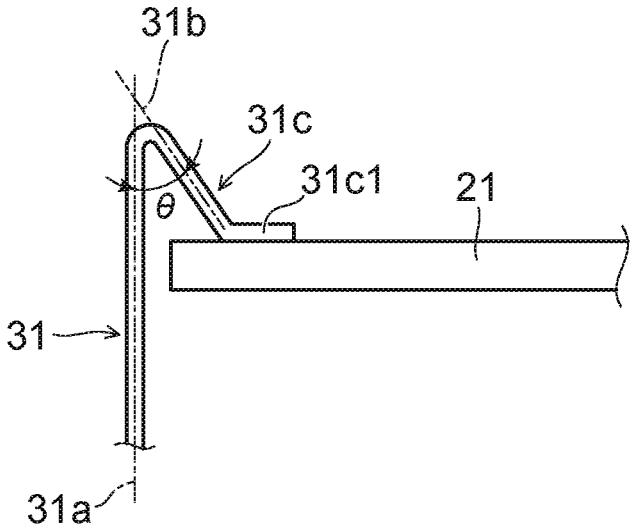

FIGS. 4A and 4B are schematic diagrams for exemplifying the power-supply terminal 31 according to another embodiment.

As illustrated in FIG. 4A, the angle θ may be less than 90°. In this manner, the elastic force of the part 31*c* of the power-supply terminal 31 can be used with ease, and thus contact between the tip part of the power-supply terminal 31 and the wiring pattern 21*a* is facilitated.

As illustrated in FIG. 4B, the angle θ may be less than 90° and a tip part 31*c*1 of the part 31*c* of the power-supply terminal 31 that is bent toward the substrate 21 may be substantially parallel to the surface of the substrate 21. In this manner, it is possible to lengthen the contact length between the tip part 31*c*1 and the wiring pattern 21*a*. In addition, soldering is facilitated.

The vehicular luminaire 1 undergoes vibration resulting from traveling or the like and vibration from an engine or the like.

As described above, the vehicular luminaire 1 has a temperature of use environment of 40° C. below zero to 85° C. above zero. Accordingly, thermal stress is generated between the power-supply terminal 31 and the substrate.

The angle θ is less than 90° in the power-supply terminal 31 according to the present embodiment.

Accordingly, it is possible to absorb vibration and a thermal expansion difference at the part where the power-supply terminal 31 is bent. Accordingly, it is possible to suppress inconvenience such as detachment of the soldering part of the power-supply terminal 31.

In the power-supply terminal 31 that is exemplified in FIGS. 3, 4A, and 4B, the substrate 21 is provided between the part 31*c* of the power-supply terminal 31 and the bottom surface 11*a*1 of the recessed portion 11*a*. In this case, the part 31*c* of the power-supply terminal 31 may be formed by, for example, the tip part of the power-supply terminal 31 being folded after the substrate 21 is provided on the socket 10.

Figure 5A:
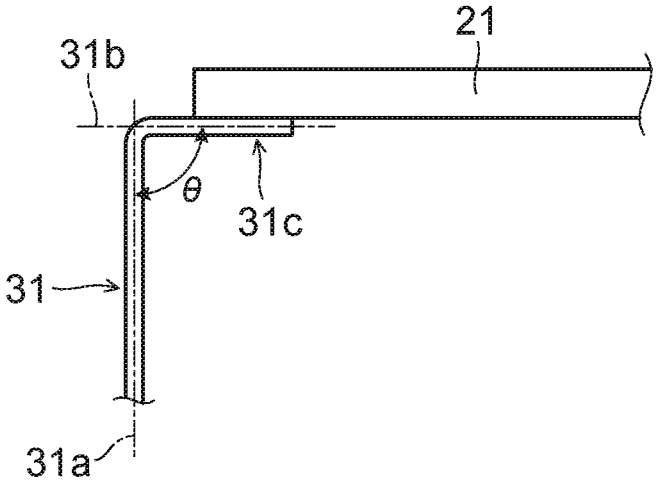
FIGS. 5A and 5B are schematic diagrams for exemplifying the power-supply terminal according to another embodiment.
Figure 5B:
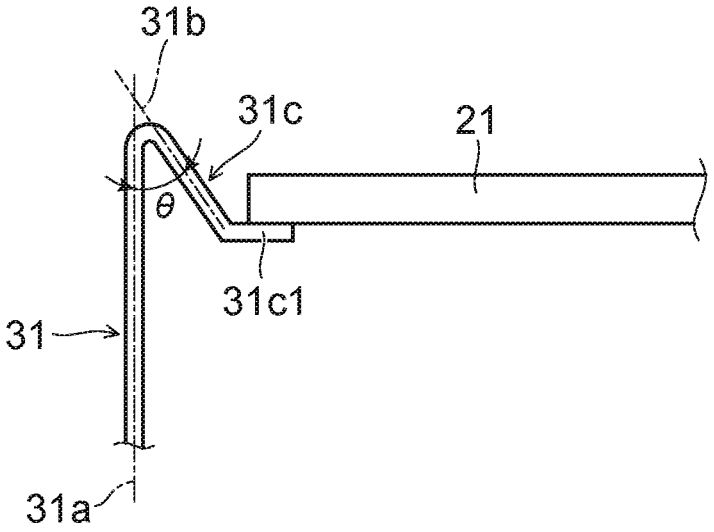

FIGS. 5A and 5B are schematic diagrams for exemplifying the power-supply terminal 31 according to another embodiment.

As illustrated in FIG. 5A, the part 31*c* of the power-supply terminal 31 may be brought into contact with the surface of the substrate 21 that is on the bottom surface 11*a*1 side (rear surface side) of the recessed portion 11*a*.

As illustrated in FIG. 5B, the tip part 31*c*1 of the power-supply terminal 31 may be brought into contact with the surface of the substrate 21 that is on the bottom surface 11*a*1 side of the recessed portion 11*a*.

In this manner, the power-supply terminal 31 can be bent in advance. Accordingly, manufacturing can be simplified and manufacturing cost reduction can be achieved.

In this case, the wiring patterns 21*a* may be formed on both surfaces of the substrate 21 and the wiring patterns 21*a* may be electrically connected to each other with an electrically conductive via or the like.

In addition, soldering may be omitted as the tip of the power-supply terminal 31 is pressed against the substrate 21.

Figure 6A:
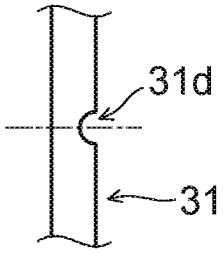
FIGS. 6A and 6B are schematic diagrams for exemplifying the power-supply terminal that is yet to be folded.
Figure 6B:
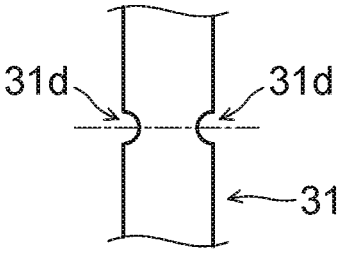

FIGS. 6A and 6B are schematic diagrams for exemplifying the power-supply terminal 31 that is yet to be folded.

As illustrated in FIGS. 6A and 6B, a notch 31*d* may be provided at the part where the power-supply terminal 31 is folded. Folding is facilitated in this manner. In addition, folding accuracy improvement can be achieved as spring-back can be reduced.

Figure 7A:
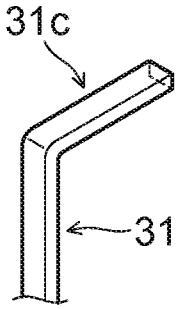
FIGS. 7A and 7B are schematic perspective views for exemplifying the tip shape of the power-supply terminal.
Figure 7B:
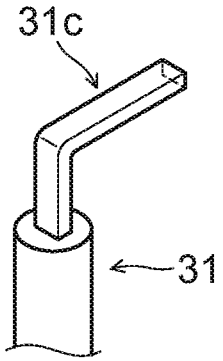

FIGS. 7A and 7B are schematic perspective views for exemplifying the tip shape of the power-supply terminal 31.

As illustrated in FIGS. 7A and 7B, the part 31*c* of the power-supply terminal 31 preferably has a flat shape. In other words, the part 31*c* that is bent toward the substrate 21 preferably has a flat cross-sectional shape. For example, the cross-sectional length in the direction that is parallel to the surface of the substrate 21 may be longer than the cross-sectional length in the direction that is perpendicular to the surface of the substrate 21. In this manner, the contact area between the power-supply terminal 31 and the wiring pattern 21*a* can be increased. In addition, soldering can be facilitated. Further, folding accuracy improvement can be achieved as folding-direction variations can be reduced.

As illustrated in FIG. 7A, the flat shape may be formed by folding of the power-supply terminal 31 that has a flat cross-sectional shape (such as a rectangular shape).

In addition, as illustrated in FIG. 7B, the tip of the power-supply terminal 31 that has a circular or quadrangular cross-sectional shape may be crushed to be given a flat shape. For example, the tip of the power-supply terminal 31 may be crushed by pressing or the like.

Figure 8:
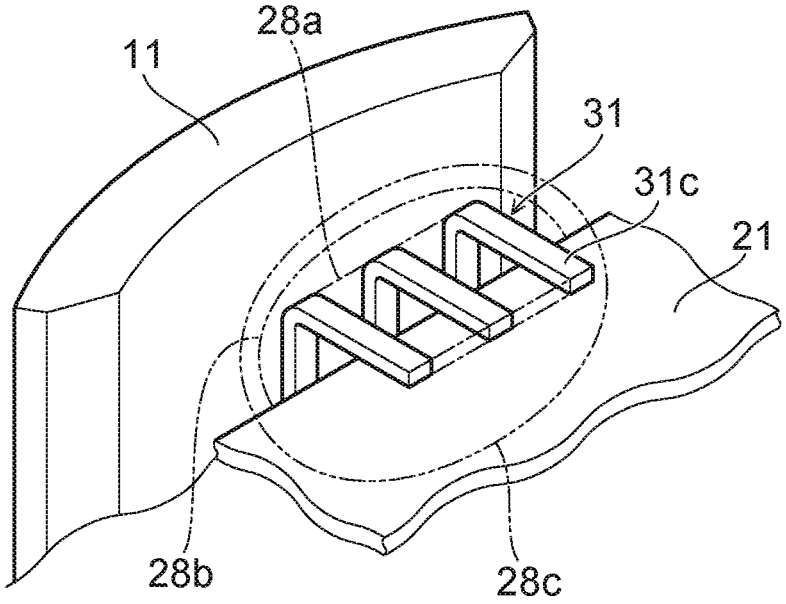
FIG. 8 is a schematic perspective view for exemplifying insulating portions.

FIG. 8 is a schematic perspective view for exemplifying insulating portions 28*a* to 28*c*.

The part 31*c* of the power-supply terminal 31 is formed by folding, and thus a certain length is required. As described above, the vehicular luminaire 1 undergoes vibration, and thus a short circuit may occur between the parts 31*c* when the plurality of power-supply terminals 31 have a short pitch dimension.

As illustrated in FIG. 8, a short circuit between the parts 31*c* can be prevented when the insulating portion 28*a* is provided between the parts 31*c*.

As described above, the mounting portion 11 may be formed of a highly heat-conductive material. The highly heat-conductive material may be electrically conductive. Accordingly, when the distance between the part 31*c* and the mounting portion 11 is short, a short circuit may occur between the part 31*c* and the mounting portion 11.

As illustrated in FIG. 8, a short circuit between the part 31*c* and the mounting portion 11 can be prevented when the insulating portion 28*b* is provided between the part 31*c* and the mounting portion 11.

As illustrated in FIG. 8, short circuits can be prevented between the parts 31*c* and between the part 31*c* and the mounting portion 11 when the insulating portion 28*c* that provides covering between the parts 31*c* and between the part 31*c* and the mounting portion 11 is provided.

In other words, the insulating portions 28*a* to 28*c* may be provided in at least one of the space between the plurality of parts 31*c* bent toward the substrate 21 and the space between the socket 10 and the plurality of parts 31*c* bent toward the substrate 21.

The insulating portions 28*a* to 28*c* may be formed by, for example, an insulating resin being supplied. The resin supply may be performed, for example, by means of a liquid dispensing device such as a dispenser. A silicone resin or the like may be supplied as the resin.

(Method for Manufacturing Vehicular Luminaire)

Next, a method for manufacturing the vehicular luminaire will be described.

The socket 10 is formed by an injection molding method, a die casting method, or the like.

The power-supply unit 30 is formed by the plurality of power-supply terminals 31 being press-fitted into the holes of the insulating portion 32 or the plurality of power-supply terminals 31 and the insulating portion 32 being integrally molded by an insert molding method.

In addition, the light-emitting module 20 is formed.

First, the light-emitting element 22, the resistor 23, and the control element 24 are sequentially mounted on the substrate 21 having the wiring pattern 21*a*.

Subsequently, the light-emitting element 22 and the wiring pattern 21*a* are electrically connected to each other by a wire bonding method.

Subsequently, the frame portion 25 is bonded to the substrate 21 such that the light-emitting element 22 is surrounded.

Subsequently, the sealing portion 26 is formed by the inside of the frame portion 25 being filled with a resin. The resin filling may be performed, for example, by means of a liquid dispensing device such as a dispenser.

Next, the power-supply unit 30, the heat transfer unit 40, and the light-emitting module 20 are sequentially assembled to the socket 10.

When the part 31*c* of the power-supply terminal 31 is provided on the surface side of the substrate 21, the part 31*c* is formed by the tip of the power-supply terminal 31 being folded.

Subsequently, the part 31*c* of the power-supply terminal 31 and the wiring pattern 21*a* are soldered.

When the part 31*c* of the power-supply terminal 31 is provided on the rear surface side of the substrate 21, the plurality of power-supply terminals 31 where the parts 31*c* are formed in advance may be integrated with the insulating portion 32. The light-emitting module 20 is subsequently assembled on the plurality of parts 31*c*.

The vehicular luminaire 1 may be manufactured in the above manner.

As described above, the vehicular luminaire manufacturing method according to the present embodiment may include bending the vicinity of the end portions of the plurality of power-supply terminals 31 that are exposed from the socket 10 toward the substrate 21 or providing the substrate 21 on the plurality of power-supply terminals 31 bent in the vicinity of the end portions exposed from the socket 10.

The content of each may be identical to the above description, and thus will not be described in detail.

(Vehicular Lamp)

Next, the vehicular lamp 100 will be exemplified.

In the following description, a case where the vehicular lamp 100 is a front combination light provided in an automobile will be described as an example. However, the vehicular lamp 100 is not limited to the front combination light provided in an automobile. The vehicular lamp 100 may also be a vehicular lamp provided in an automobile, a railroad vehicle, or the like.

Figure 9:
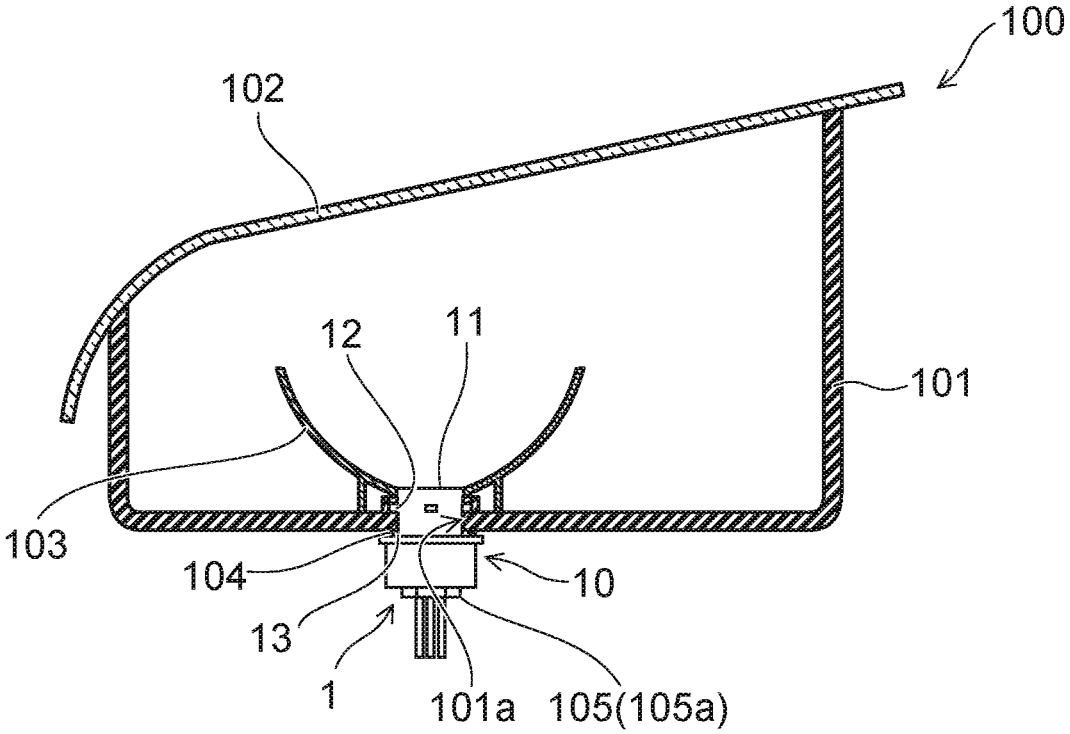
FIG. 9 is a schematic partial cross-sectional view for exemplifying a vehicular lamp.

FIG. 9 is a schematic partial cross-sectional view for exemplifying the vehicular lamp 100.

As illustrated in FIG. 9, the vehicular lamp 100 is provided with the vehicular luminaire 1, the housing 101, a cover 102, an optical element portion 103, a seal member 104, and the connector 105.

The vehicular luminaire 1 is attached to the housing 101. The housing 101 holds the mounting portion 11. The housing 101 has a box shape with one end portion side open. The housing 101 may be formed of, for example, a resin that does not transmit light. An attachment hole 101*a* into which the part of the mounting portion 11 where the bayonet 12 is provided is inserted is provided in the bottom surface of the housing 101. A recessed portion into which the bayonet 12 provided in the mounting portion 11 is inserted is provided at the peripheral edge of the attachment hole 101*a*. Although a case where the attachment hole 101*a* is directly provided in the housing 101 is exemplified above, an attachment member having the attachment hole 101*a* may be provided in the housing 101 instead.

When the vehicular luminaire 1 is attached to the vehicular lamp 100, the part of the mounting portion 11 where the bayonet 12 is provided is inserted into the attachment hole 101*a* and the vehicular luminaire 1 is rotated. Then, the bayonet 12 is held in the recessed portion provided at the peripheral edge of the attachment hole 101*a*. This attachment method is called twist lock.

The cover 102 is provided so as to block the opening of the housing 101. The cover 102 may be formed of a translucent resin or the like. The cover 102 is capable of functioning as a lens or the like as well.

The light that is emitted from the vehicular luminaire 1 is incident on the optical element portion 103. The optical element portion 103 reflects, diffuses, guides, and collects the light that is emitted from the vehicular luminaire 1, forms a predetermined luminous intensity distribution pattern, and so on.

For example, the optical element portion 103 that is exemplified in FIG. 9 is a reflector. In this case, the optical element portion 103 reflects the light emitted from the vehicular luminaire 1 for a predetermined luminous intensity distribution pattern to be formed.

The seal member 104 is provided between the flange 13 and the housing 101. The seal member 104 may be annular. The seal member 104 may be formed of an elastic material such as rubber and silicone resin.

When the vehicular luminaire 1 is attached to the vehicular lamp 100, the seal member 104 is sandwiched between the flange 13 and the housing 101. Accordingly, the internal space of the housing 101 is sealed by the seal member 104. In addition, the bayonet 12 is pressed against the housing 101 by the elastic force of the seal member 104. Accordingly, detachment of the vehicular luminaire 1 from the housing 101 can be prevented.

The connector 105 is fitted to the end portions of the plurality of power-supply terminals 31 exposed inside the hole 10*b*. A power supply (not illustrated) or the like is electrically connected to the connector 105. Accordingly, the power supply (not illustrated) or the like and the light-emitting element 22 are electrically connected to each other by the connector 105 being fitted to the end portions of the plurality of power-supply terminals 31.

The connector 105 has a step part. The seal member 105*a* is attached to the step part. The seal member 105*a* is provided so as to prevent the inside of the hole 10*b* from being permeated by water. When the connector 105 that has the seal member 105*a* is inserted into the hole 10*b*, the hole 10*b* is sealed so as to be watertight.

The seal member 105*a* may be annular. The seal member 105*a* may be formed of an elastic material such as rubber and silicone resin. The connector 105 may be joined to a socket 10 side element, for example, by means of an adhesive.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments may be combined mutually and may be carried out.

What is claimed is:

1. A vehicular luminaire comprising:

a socket;

a substrate provided on the socket and including a wiring pattern on at least one surface;

at least one light-emitting element electrically connected to the wiring pattern;

a first insulating portion being provided inside the socket;

a plurality of power-supply terminals extending inside the first insulating portion, each of the plurality of power-supply terminals including one end portion exposed from the socket, and a part, in a vicinity of the end portion, bent toward the substrate, wherein every bent part of all power-supply terminals of the vehicular luminaire is provided side by side with another one of the bent parts along one side of the substrate; and a second insulating portion being provided in a space between the plurality of parts bent toward the substrate and overlapping at least a side surface of the plurality of parts bent toward the substrate.

2. The luminaire according to claim 1, wherein the end portion is provided on a surface of the substrate on a side where the light-emitting element is provided or a surface of the substrate on a side opposite to the side where the light-emitting element is provided.

3. The luminaire according to claim 1, wherein a center line of at least one of the plurality of parts of the power-supply terminals bent toward the substrate intersects with a center line of a part extending inside the socket.

4. The luminaire according to claim 1, wherein an angle formed by a center line of one of the plurality of parts bent toward the substrate and a center line of a part extending inside the socket is 90° or less.

5. The luminaire according to claim 4, wherein the angle is less than 90° and a tip part of the one of the plurality of parts bent toward the substrate is substantially parallel to a surface of the substrate.

6. The luminaire according to claim 1, wherein at least one of the plurality of parts bent toward the substrate is flat in cross-sectional shape.

7. The luminaire according to claim 1, wherein the second insulating portion is further provided in a space between the socket and the plurality of parts bent toward the substrate.

8. The luminaire according to claim 1, wherein the vicinity of the end portion is not provided in a hole provided in the substrate.

9. The luminaire according to claim 2, wherein the end portion is in contact with the wiring pattern provided on the surface on the side where the light-emitting element is provided.

10. The luminaire according to claim 2, wherein the end portion is in contact with the wiring pattern provided on the surface on the side opposite to the side where the light-emitting element is provided.

11. The luminaire according to claim 2, wherein the end portion is soldered to the wiring pattern provided on the surface on the side where the light-emitting element is provided.

12. The luminaire according to claim 2, wherein the end portion is soldered to the wiring pattern provided on the surface on the side opposite to the side where the light-emitting element is provided.

13. The luminaire according to claim 1, wherein a notch is provided at at least one of the plurality of parts of the power-supply terminals bent toward the substrate.

14. The luminaire according to claim 1, wherein a cross-sectional length of at least one of the plurality of parts bent toward the substrate in a direction parallel to a surface of the substrate is longer than a cross-sectional length of the at least one of the plurality of parts in a direction perpendicular to the surface of the substrate.

15. The luminaire according to claim 6, wherein the flat cross-sectional shape is a rectangular shape.

16. The luminaire according to claim 1, wherein at least one of the plurality of parts bent toward the substrate is flat in cross-sectional shape and a part connected to the at least one of the plurality of parts toward the substrate is circular in cross section.

17. The luminaire according to claim 1, wherein the second insulating portion contains an insulating resin.

18. The luminaire according to claim 1, wherein the socket contains a highly heat-conductive resin.

19. A vehicular lamp comprising:

the luminaire according to claim 1; and a housing to which the luminaire is attached.

20. A method for manufacturing the luminaire according to claim 1, comprising:

forming a power-supply unit having the plurality of power-supply terminals and the first insulating portion;

assembling the power-supply unit to the socket bending the vicinity of the end portions of the plurality of power-supply terminals exposed from the socket toward the substrate; or providing the substrate on the plurality of power-supply terminals bent in the vicinity of the end portions exposed from the socket; and forming the second insulating portion by supplying an insulating resin to a space between a plurality of parts bent.

* * * * *